US006173150B1

(12) United States Patent
Suzuki et al.

(10) Patent No.: US 6,173,150 B1
(45) Date of Patent: Jan. 9, 2001

(54) SEPARATION CHARGER FOR AN IMAGE FORMING APPARATUS

(75) Inventors: Shinya Suzuki, Shizuoka-ken; Toru Katsumi, Mishima; Motohiro Fujiwara, Shizuoka-ken, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/457,313

(22) Filed: Dec. 9, 1999

(30) Foreign Application Priority Data

Dec. 15, 1998 (JP) ..... 10-375291

(51) Int. Cl.[7] ..... G03G 15/16

(52) U.S. Cl. ..... 399/315; 399/22; 399/44; 399/398

(58) Field of Search ..... 399/315, 22, 66, 399/44, 397, 398

(56) References Cited

U.S. PATENT DOCUMENTS 4,286,862 * 9/1981 Akita et al. ..... 399/398
4,357,092 * 11/1982 Nagoshi ..... 399/315
5,541,718 * 7/1996 Oono ..... 399/398
5,633,703 * 5/1997 Takenouchi et al. ..... 399/315
6,009,286 * 9/1981 Watanabe et al. ..... 399/44

FOREIGN PATENT DOCUMENTS 62-159165 7/1987 (JP) .
10-78705 3/1998 (JP) .

* cited by examiner

*Primary Examiner*—Quana M. Grainger
(74) *Attorney, Agent, or Firm*—Fitzpatrick, Cella, Harper & Scinto

(57) ABSTRACT

An image forming apparatus includes an image bearer for bearing a toner image, transfer device for transferring the toner image on the image bearer to a recording medium, a separating charger for facilitating separation of the recording medium from the image bearer, a detector for detecting an image amount in a predetermined area on the image bearer, the predetermined area corresponding to a predetermined downstream side area from a leading edge of the recording material, and a controller for controlling an application voltage to the separating charger from a leading edge to a trailing edge of the recording material on the basis of the image amount in the predetermined area detected by the detector.

6 Claims, 7 Drawing Sheets

SEPARATION CHARGER FOR AN IMAGE FORMING APPARATUS

BACKGROUND OF THE INVENTION

1. Field of the Invention

The present invention relates to image forming apparatuses such as a copying machine and a printer in which an electrophotographic system, and an electrostatic recording system are used.

2. Related Background Art

In a conventional image forming apparatus, after applying toner as a developer to a latent image bearer bearing a latent image in accordance with image information to form the latent image into a toner image, the toner image is transferred to a transfer material as a recording medium. An image forming apparatus provided with a separating charger as separation charging means for forming an electric field between the transfer material with the toner image transferred thereon and the latent image bearer to separate the transfer material from the latent image bearer is known, and placed for practical use.

Moreover, in the image forming apparatus, it is proposed that an electric current for the separating charger to form the electric field (hereinafter referred to as the separation current) be appropriately adjusted in accordance with the total amount of image information to the transfer material. For example, as an extreme example, in a solid white image (image information amount of zero), since no toner particle is between the latent image bearer and the transfer material, the electrostatic adsorbability of the transfer material to the latent image bearer becomes very large, and poor separability tends to occur, which requires a strong electricity eliminating effect and a large separation current. On the other hand, in a solid black image (the maximum image information amount), when the electricity of the transfer material is strongly eliminated, the toner once transferred onto the transfer material is reverse-transferred onto the latent image bearer, that is, a so-called re-transfer phenomenon occurs. Therefore, the separation current needs to be set to a not very large value. Therefore, it is useful to adjust the separation current in accordance with the total amount of image information. Therefore, in the conventional apparatus, the separation current is controlled in accordance with the image density of the original to be read as described in Japanese Patent Application Laid-Open No. 62-159165, or the image ratio of the entire original is calculated to control the separation current in accordance with the ratio as described in Japanese Patent Application Laid-Open No. 10-78705.

However, when the separation current calculated based on the image ratio of the entire original is supplied through the entire transfer material, the separation current does not necessarily take an optimum value, unnecessarily much separation current is supplied, and re-transfer is caused in latter half portion of the transfer material in the conveying direction.

Moreover, when the image ratio is calculated from the read original to determine the separation current, and when enlargement, reduction, rotating negative/positive reversing, or another processing is performed, the image ratio of the original is different from the image ratio of the image transferred onto the transfer material. Therefore, too much or too less separation current is supplied to the transfer material, and the jamming of the transfer material by re-transfer or poor separability is caused in some cases.

SUMMARY OF THE INVENTION

An object of the present invention is to provide an image forming apparatus in which neither re-transfer nor poor separability occurs.

Another object of the present invention is to provide an image forming apparatus which can supply an optimum separation current.

Further object of the present invention is to provide an image forming apparatus which comprises:

- an image bearer for bearing a toner image;
- transfer means for transferring the toner image on the image bearer to a recording medium;
- a separating charger for facilitating separation of the recording medium from the image bearer;
- detecting means for detecting an image amount of a leading edge side area excluding a rear end side of the recording medium; and
- control means for controlling a voltage to be applied to the separating charger based on an output of the detecting means.

Further objects of the present invention will be apparent in the following description.

DESCRIPTION OF THE PREFERRED EMBODIMENTS

Embodiments of the present invention will be described hereinafter with reference to the drawings.

(First Embodiment)

Figure 1:
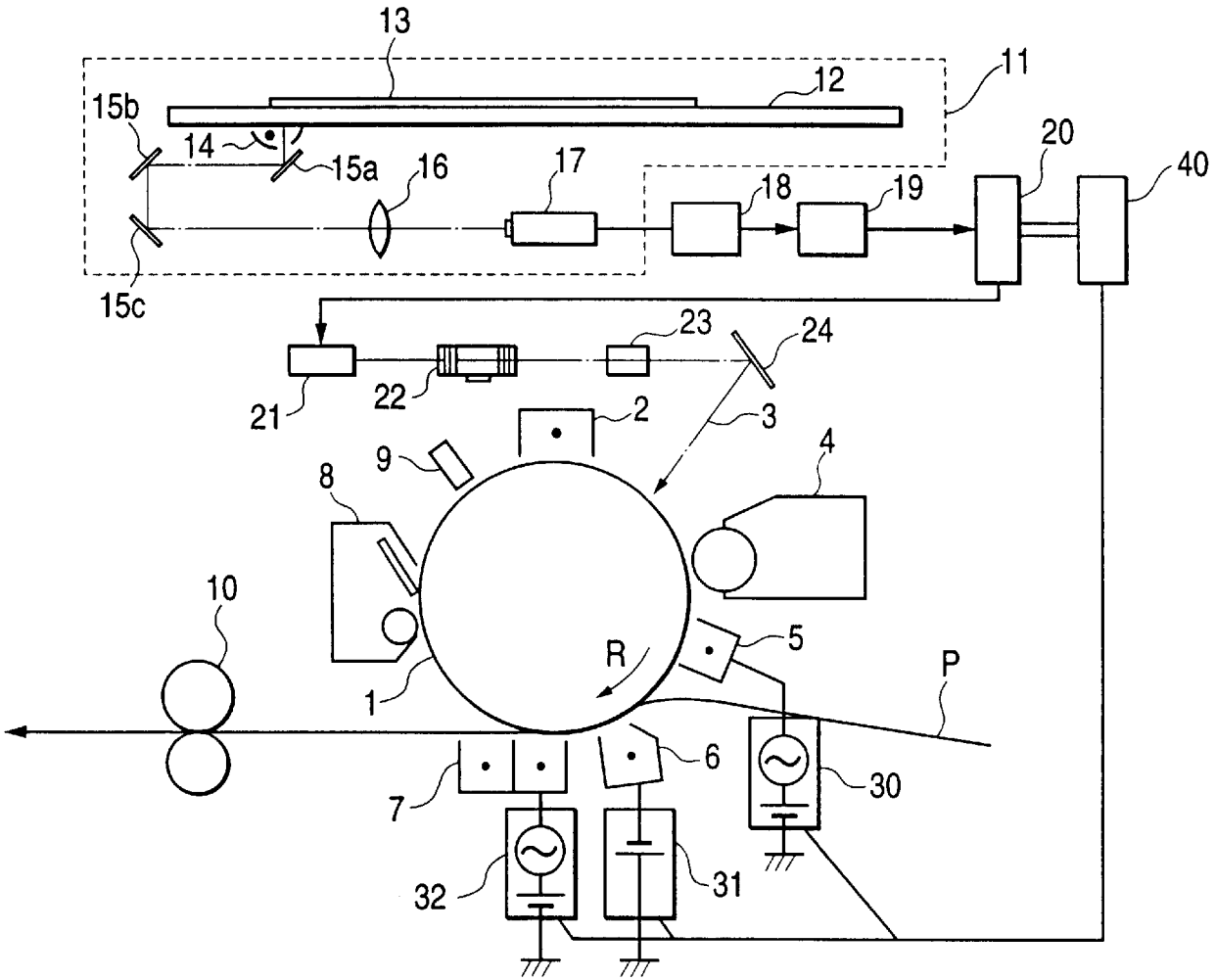
FIG. 1 is a schematic view showing an image forming apparatus according to a first embodiment of the present invention.

FIG. 1 is a schematic diagram showing one example of an image forming apparatus according to a first embodiment of the present invention. Additionally, in the embodiment, a reverse developing system copying machine will be described as an example of the image forming apparatus.

In the image forming apparatus, as shown in FIG. 1, a photosensitive drum 1 as a latent image bearer is supported so that it can rotate in a direction of arrow R in FIG. 1. Moreover, the image forming apparatus is provided, around the photosensitive drum 1, with a primary charger 2, an exposure apparatus 3, a developing unit 4, a pre-transfer charger 5, a transfer charger 6, a separating charger 7 as separation charging means, a cleaner 8 and a pre-exposure lamp 9 in order of its rotating direction, and a fixing unit 10 is disposed on the outer extension of the separating charger 7. The image forming apparatus is further provided with an image scanner 11 above the photosensitive drum 1.

The image scanner 11 is provided with a photoelectric converting element (CCD) 17 as an image reading apparatus. An original 13 laid on an original glass base 12 is scanned by a lighting lamp 14, and a reflected light from the original 13 is guided via mirrors 15*a,* 15*b,* 15*c,* and formed into an image on the photoelectric converting element 17 by a lens 16.

The photoelectric converting element 17 reads the image information of the original 13, and outputs an analog electric signal. After the analog electric signal is converted to a digital image signal by an A/D converter 18, the signal is transmitted to an image processing apparatus 19. The image processing apparatus 19 generates an image signal (video signal) for driving a semiconductor laser 21.

The image signal generated by the image processing apparatus 19 is transmitted to a laser drive (not shown), the light emitted from the semiconductor laser 21 is modulated in response to the image signal by the drive of the laser driver, the laser beam modulated in response to the signal is guided to the charged photosensitive drum 1 via a polygonal mirror 22, a cylindrical lens 23, and a mirror 24 to perform exposure in accordance with the image information, and an electrostatic latent image is written on the photosensitive drum 1.

A video counter 20 as integrating means is disposed between the image processing apparatus 19 and the semiconductor laser 21, and the video counter 20 is connected to the interface of a control circuit (CPU) 40 as calculating and adjusting means. In this video counter 20, the image information amount of the image to be written on the photosensitive drum 1 corresponding to a downstream area in a range up to a predetermined distance from the conveying direction leading edge of the transfer material is integrated based on the video signal from the image processing apparatus 19. The image information amount is divided by a transfer material width L (width of a direction parallel with the rotating shaft of the photosensitive drum 1) in the control circuit 40, so that the image ratio normalized with respect to the transfer material width is calculated. In the present invention, image information amount Vi up to 50 mm from the leading edge of the image along the feeding direction of the transfer material is integrated, and the integrated value $\Sigma Vi$ is divided by the width L to obtain value $e=(\Sigma Vi)/L$ as the normalized image ratio. Additionally, the image information amount Vi is an image density value of each dot cell constituting the written image.

The pre-transfer charger 5 has a high voltage power source 30 constituted by connecting an alternating-current power source and a direct-current power source in series, and the alternating-current power source has a rectangular wave output with VPP of 8 kV and frequency of 700 Hz. Moreover, the direct-current power source is constituted of a constant-current power source which changes the positive/negative current amount of the alternating current by varying the direct-current voltage to be added to the alternating-current voltage, which can vary the direct current (a difference of positive/negative current, hereinafter referred to as the difference current) in the range of 0 to +300 $\mu$A, and which can control the difference current to be constant. Additionally, the output of the high voltage power source 30 is appropriately adjusted by the control circuit (CPU) 40.

The transfer charger 6 has a high voltage power source 31 constituted of a constant-current power source which can vary the direct current in the range of 0 to −650 $\mu$A, and the output of the high voltage power source 31 is similarly appropriately adjusted by the control circuit 40.

Moreover, a high voltage power source 32 for the separating charger 7 is constituted by connecting an alternating-current power source and a direct-current power source in series, and the alternating-current power source has a sinusoidal wave output with VPP of 11.5 kV and frequency of 700 Hz. Additionally, the direct-current power source is a constant-current power source whose difference current is variable in the range of 0 to +500 $\mu$A. Similarly, the output of the high voltage power source 32 is controlled by the control circuit 40.

The photosensitive drum 1 is constituted by forming a photoconductive layer on a cylindrical conductive base body, and an a-Si photosensitive body with an amorphous silicon layer as the photoconductive layer formed thereon is used in the embodiment.

The image formation by the image forming apparatus of the embodiment will be described with reference to FIGS. 2A to 2E.

Figure 2A:
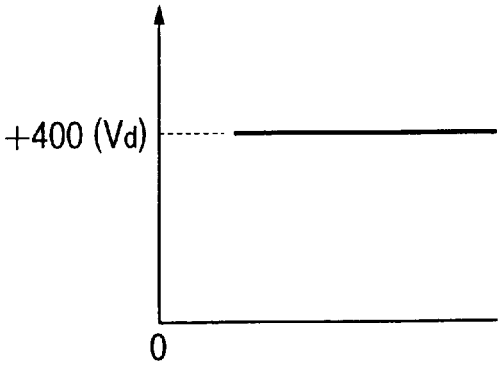
FIGS. 2A, 2B, 2C, 2D and 2E are diagrams showing the surface potential of a photosensitive drum in a developing process in the image forming apparatus of FIG. 1.
Figure 2B:
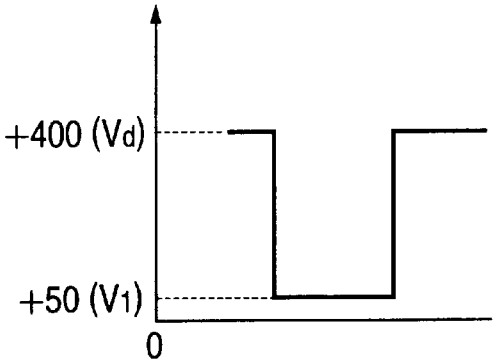

First, as shown in FIG. 2A, the surface of the photosensitive drum 1 is uniformly charged by the primary charger 2 to provide a maximum potential value +400 V (Vd), and an electrostatic latent image of an exposed potential +50 V (V) is formed by irradiation from the exposure apparatus 3 as shown in FIG. 2B. Here, Vd denotes a potential charged by the primary charger 2, and V1 denotes a potential attenuated by the irradiation from the exposure apparatus 3.

Figure 2C:
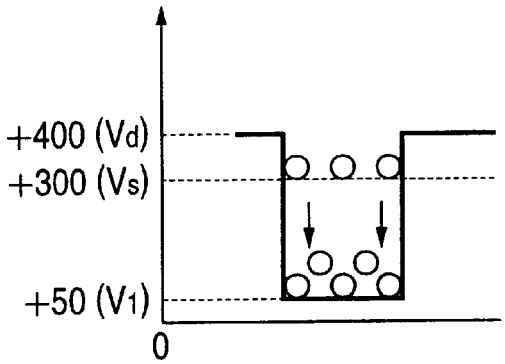

Subsequently, by applying a direct-current voltage Vs to the developing roller which is rotatably supported by the developing unit 4 to face the photosensitive drum 1 and which bears toner, the electrostatic latent image is reverse-developed by the positive charged toner to form a toner image as shown in FIG. 2C. Additionally, it is ideal that the entire toner is positively charged, but actually the negatively charged toner exists. The negatively charged toner is developed into an image in a potential section of +400 V.

Figure 2D:
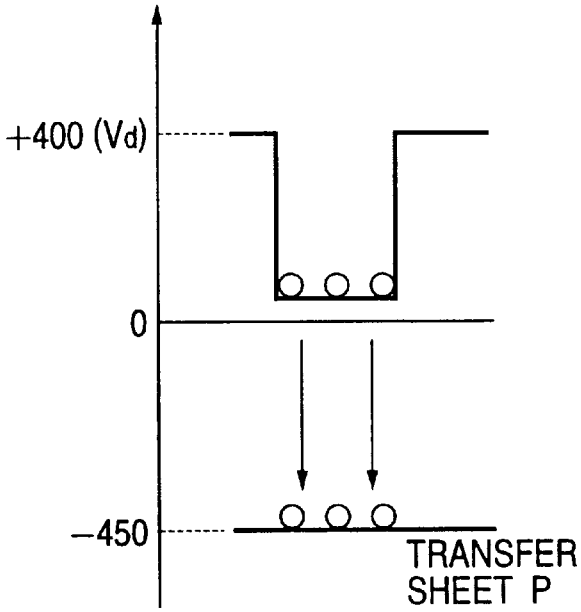
Figure 2E:
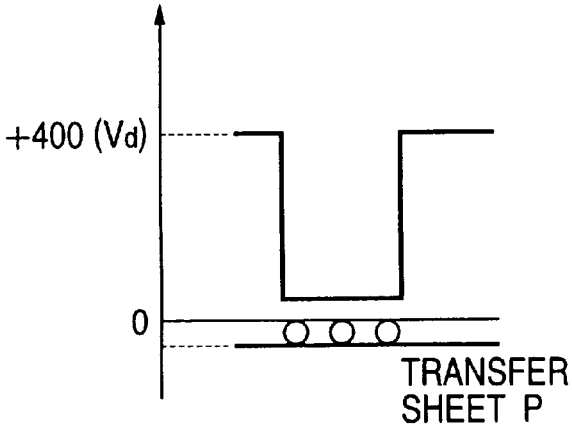

Then, the toner charging amount is substantially uniformed by the pre-transfer charger 5. An electric charge is applied to the reverse surface of a transfer material P by the transfer charger 6, the reverse surface potential of the transfer material P is set to −450 V as shown in FIG. 2D, and the toner image is transferred to the transfer material P. Subsequently, the unnecessary electric charge applied to the reverse surface of the transfer material P is removed by the separating charger 7, the potential of the transfer material P is set to about 0 V as shown in FIG. 2E, the adsorbability between the transfer material P and the photosensitive drum 1 is weakened, the transfer material P is effectively separated from the photosensitive drum 1, and a desired image can be obtained on the transfer material P.

Thereafter, the transfer material P is electrostatically separated from the photosensitive drum 1 by the separating charger 7, the separated transfer material P is fed to the fixing unit 10 for fixing, and the fixed image is finally obtained. The difference current of the separation current applied to the separating charger 7 has a polarity to eliminate from the reverse surface of the transfer material P the electric charge which has contributed to the holding of the transfer material P on the photosensitive drum 1 in the transfer process, that is, the difference current is positively polarized for use.

The conventional control will next be described before describing the separation control of the transfer material according to the present invention.

Figure 3:
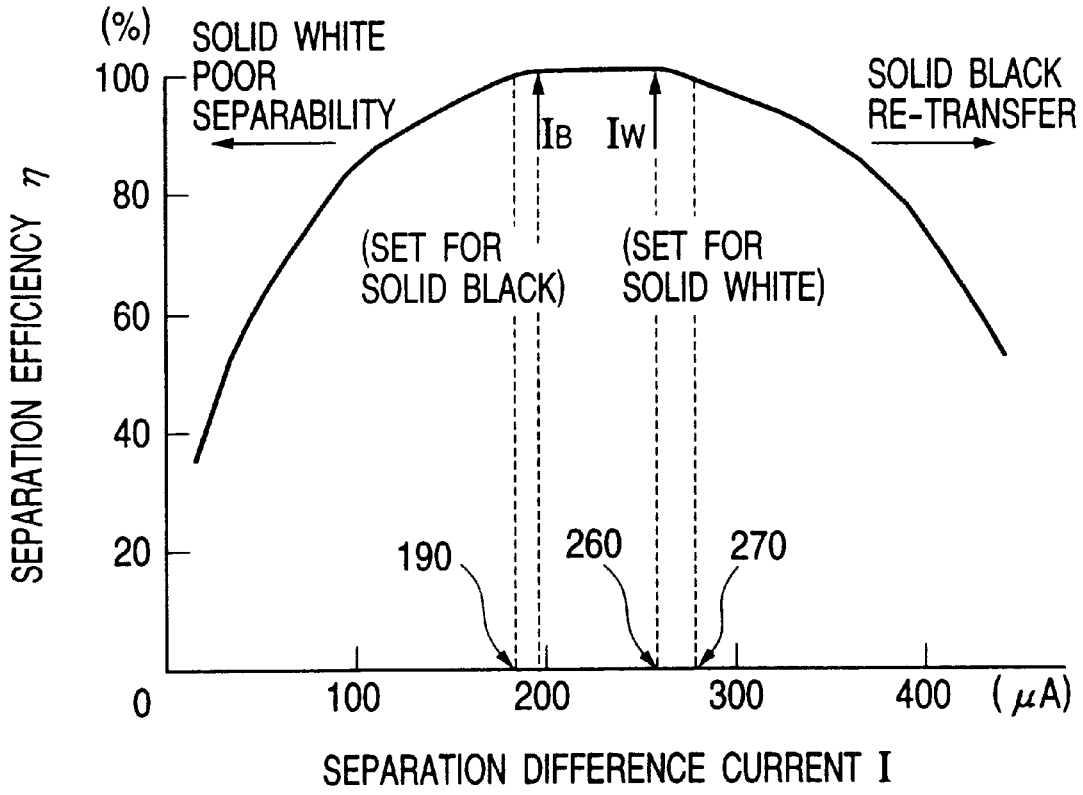
FIG. 3 is a graph showing a relation between separation difference current and separation efficiency in the first embodiment of the present invention.

FIG. 3 shows a relation between the difference current of the separation current (separation difference current) and separation efficiency $\eta$ when a black toner is transferred to the transfer material. In this case, the difference current condition of the pre-transfer charger 5 is +100 μA, and the difference current condition of the separating charger 7 is +230 μA.

The separation efficiency η is defined as the ratio with which the transfer material is passed through the transfer and separation processes and the image is effectively obtained on the separated transfer material without causing the poor separability of the transfer material or the re-transfer of the toner to the photosensitive drum. For example, in quantitative determination, the separation efficiency is 90% when the image formation is performed on 100 sheets and the poor separability or the re-transfer occurs on ten sheets, and the separation efficiency is 80% when it similarly occurs on 20 sheets.

As shown in FIG. 3, the separation efficiency η tends to be deteriorated when the separation difference current is too small or too large. When it is too small, the transfer material P cannot completely be separated from the photosensitive drum 1, thereby causing the poor separability. Conversely, when the current is too large, the toner is re-transferred to the photosensitive drum 1.

In the conventional control, for a solid white image (total image amount of 0%) with difficult separation, the separation difference current I is set to be as large as possible, for example, I=Iw (about 260 μA in the example of FIG. 3) in a range in which the separation efficiency of 100% is not lowered (this Iw indicates the separation difference current value with which there is the least possibility of the poor separability). For a solid black image with a possibility of re-transfer, the separation difference current I is set to be as small as possible, for example, I=IB (about 200 μA) in the range in which the separation efficiency of 100% is not lowered (this IB indicates the separation difference current value with which there is the least possibility of the re-transfer of the solid black image).

Figure 4:
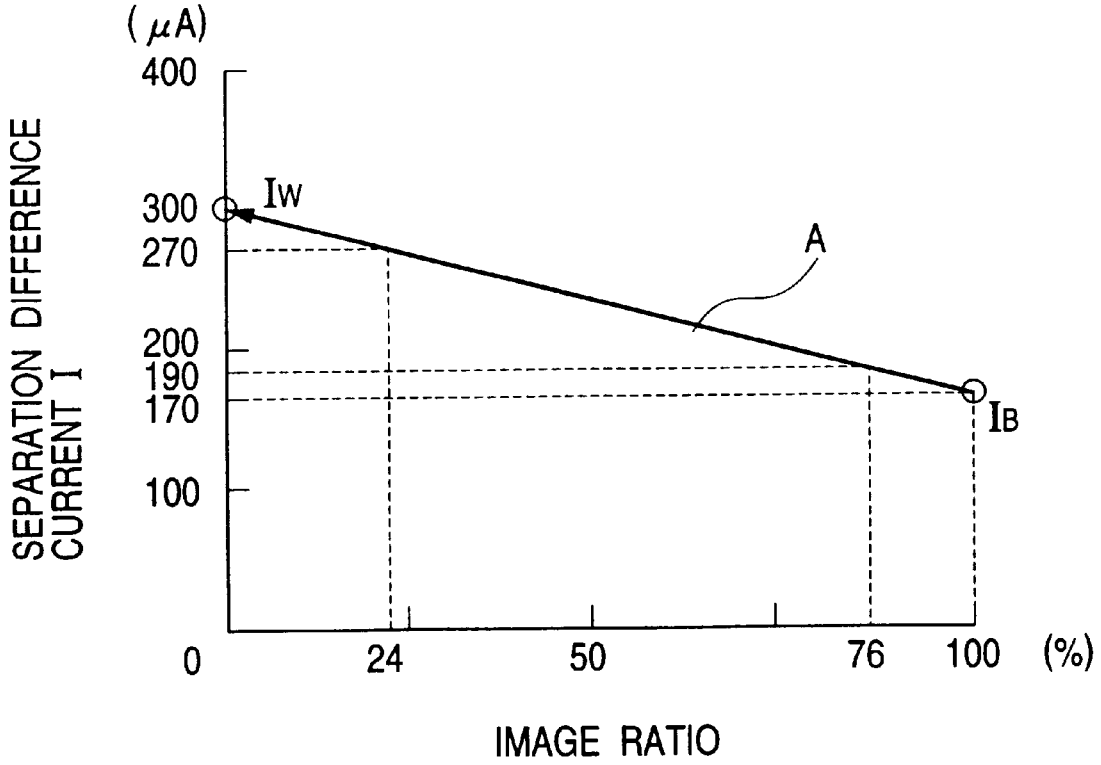
FIG. 4 is a characteristic diagram of a separation difference current to an image ratio for use in separation difference current control in the first embodiment of the present invention.

Actually, as shown in FIG. 4, a straight line (control line) is obtained by connecting the difference current values Iw and IB of solid white and black as a separation difference current control function for obtaining the separation difference current I to obtain the separation efficiency of 100% with respect to an arbitrary image ratio, and the optimum control of the separation difference current during the separating of the transfer material is performed by the image ratio based on the straight line.

As described above, in the conventional separation control of the transfer material, the separation difference current I for obtaining the transfer material separation efficiency of 100% is adjusted to provide an optimum value based on the image ratio of the entire original in accordance with the image ratio to separation difference current characteristic of FIG. 4.

In the embodiment, the image information amount of the image to be processed and written to the photosensitive drum is detected, the image ratio in the vicinity of the transfer material leading edge is obtained, and the separation current is adjusted to provide the optimum value based on the ratio in accordance with the image ratio to separation difference current characteristic of FIG. 4.

First, the control circuit 40 calculates the image ratio in the vicinity of the transfer material leading edge (this is set to e %) based on the output value of the video counter 20 in the vicinity of the transfer material leading edge. Subsequently, the optimum value of the separation difference current for the calculated image ratio of e % is determined by the straight line A of the separation difference current I of FIG. 4, and the separation control of the transfer material is performed.

Figure 5A:
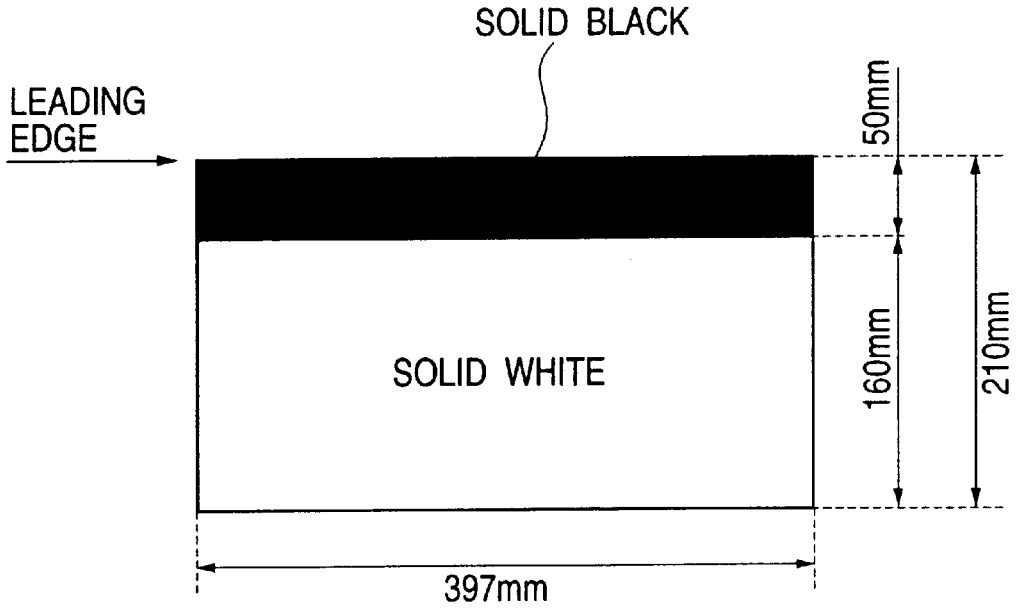
FIGS. 5A and 5B are diagrams showing the image ratio of the conveying direction leading edge portion of a recording medium in the first embodiment of the present invention.

First, as shown in FIG. 5A, it is assumed that the original to be read has A4 size (210 mm×397 mm), the area over 50 mm from the transfer material leading edge is solid black, and the middle to rear portion of the image is solid white. In the conventional separation control, since the proportion of the solid black area with respect to the area of the entire original is used as the image ratio, it is judged that the image ratio ((50×397)/(210×397)×100=24(%)) of this original is low, and a high separation difference current (about 270 μA) is applied to the entire transfer material. Therefore, the toner of the solid black portion of the transfer material leading edge is re-transferred to the photosensitive drum, thereby causing an image defect (FIG. 3).

On the other hand, in the embodiment, since only the image ratio of the transfer material leading edge of 60 mm is read, it is judged that the image ratio ((50×397)/(50×397)×100=100(%)) is low, and an appropriate separation difference current (about 170 μA) is applied to the transfer material, so that the transfer material leading edge can be separated without causing the re-transfer.

Figure 5B:
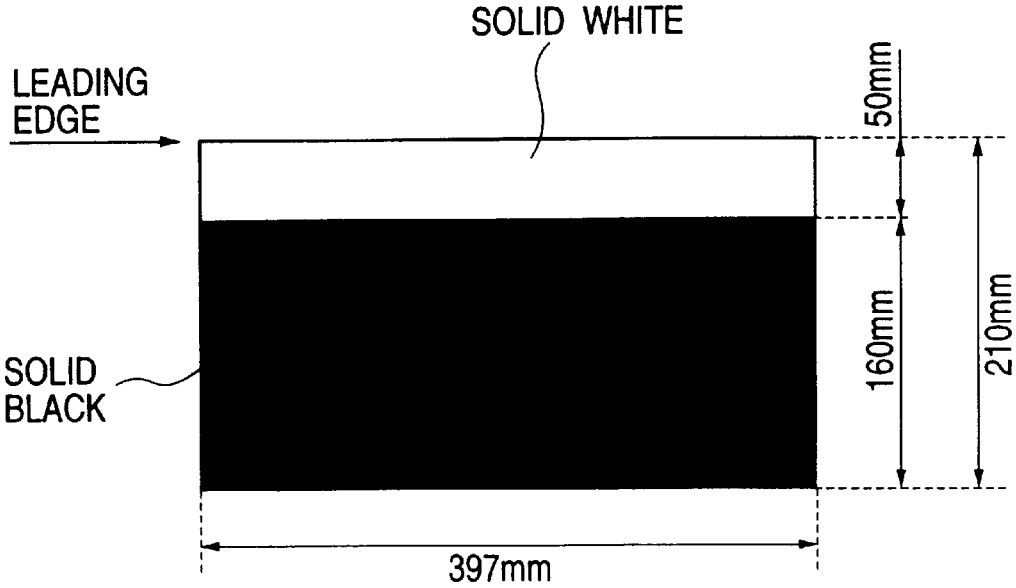

Conversely, as shown in FIG. 5B, it is assumed that the original to be read has a solid white image up to 50 mm from the leading edge, and a solid black image in the middle to rear portion. In the conventional separation control, it is judged that the image ratio ((160×397)/(210×397)×100=76(%)) of this original is high, and only a low separation difference current (about 190 μA) is applied to the entire transfer material. Therefore, the solid white portion of the transfer material leading edge fails to be separated from the photosensitive drum, and the poor separability is caused (FIG. 3).

On the other hand, in the embodiment, judging from the image ratio ((0×397)/(60×397)×100=0(%)) of the leading edge of 50 mm, an appropriate separation difference current (about 300 μA) is applied to the transfer material, so that the transfer material leading edge can be separated without causing the poor separability.

The integrated image amount ΣVi of the leading edge portion of the image to be transferred onto the transfer material takes various values by the combination of the size of the transfer material for use and the enlargement or reduction ratio of the original image to be printed. In the embodiment, by normalizing the integrated image amount with the transfer material width or the integrated area, the image ratio optimum for determining the separation difference current can advantageously be calculated for any print condition.

The advantage will be described with reference to FIGS. 6A to 6D and Table 1.

FIGS. 6A to 6D show examples of the transfer image, and Table 1 shows the calculation result of each image print condition and image ratio.

TABLE 1

| | original | Transfer Material Size | Magnifi. | Leading Edge 50 mm Solid Black Area (αΣVi) | Solid Black Area/Transfer Material Width × 100 (αΣVi/L) |
|---|---|---|---|---|---|
| a | A3 solid black | A5R | 50% | 9925 $mm^2$ | 100% |
| b | A3 solid black | A3 | 50% | 9925 $mm^2$ | 50% |
| c | A3 solid black | A5R | 50% | 9925 $mm^2$ | 100% |
| d | A3 solid black | A3 | 100% | 19850 $mm^2$ | 100% |

First, the comparison of FIGS. 6A and 6B will be described.

Figure 6A:
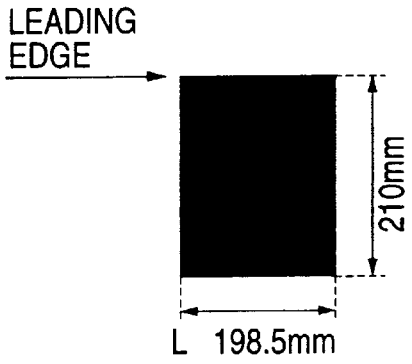
FIGS. 6A, 6B, 6C and 6D are diagrams showing a relation between transfer material width and image ratio in the first embodiment of the present invention.

FIG. 6A shows that the solid black image is formed on the entire transfer material of A5R, and the integrated image amount ΣVi of the leading edge of 50 mm is 9925. Since the integrated amount ΣVi is proportional to the solid black area, the solid black area value is indicated for the sake of convenience.

Figure 6B:
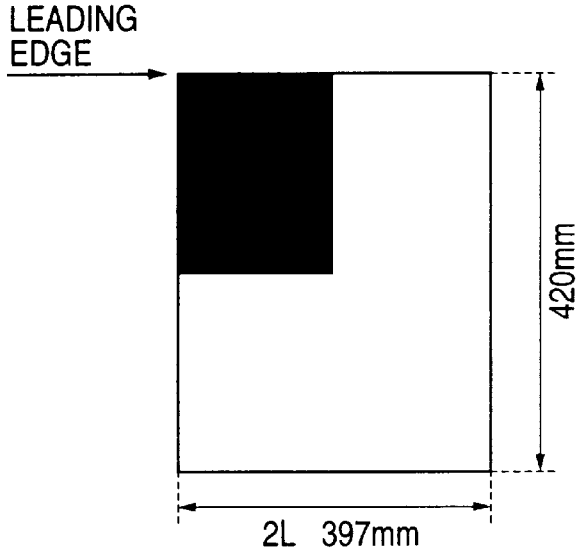

On the other hand, FIG. 6B shows that the solid black of A5R area is formed on the A3 transfer material. FIGS. 6B and 6A apparently have the same integrated amount, but FIG. 6B has solid white in its leading edge, thereby easily causing the poor separability as compared with FIG. 6A. When the integrated amount is used for determining the separation difference current as it is, the separation difference currents of FIGS. 6A and 6B are the same. For example, when the optimum low separation difference current is selected in FIG. 6A, the poor separability is generated in FIG. 6B.

Therefore, a higher current needs to be set in FIG. 6A than in FIG. 6B, and the above-described problem is solved by using the image ratio ΣVi/L obtained by dividing the integrated amount by the integrated area in the determination of the separation difference current. Therefore, the image ratio of FIG. 6B is half of that of FIG. 6A, and the separation difference currents of FIGS. 6A and 6B are about 170 μm and about 240 μA from FIG. 4, respectively, so that the optimum currents can be set.

The comparison of FIGS. 6C and 6D will next be described.

Figure 6C:
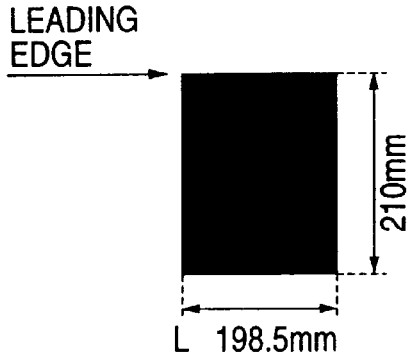
Figure 6D:
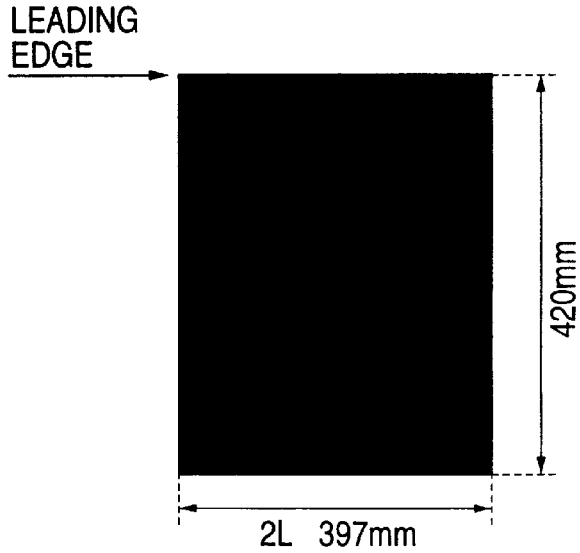

FIGS. 6C and 6D have different integrated amounts, but solid black exists in the entire leading edge width both in FIGS. 6C and 6D. In either case, the separation difference current needs to be set to be low in order to prevent the re-transfer. When the integrated amount is used in the determination of the separation difference current as it is, FIG. 6C has a relatively higher separation difference current than FIG. 6D, and the re-transfer is possibly generated in FIG. 6C. On the other hand, when the image ratio is used, FIGS. 6C and 6D have the same ratio. In either case, the separation difference current (about 170 A) can be set from FIG. 4 so that no re-transfer is caused Therefore, in the embodiment, the video counter 20 integrates the image information amount corresponding to the downstream area in the range up to 50 mm from the conveying direction leading edge of the transfer material, the control circuit 40 calculates the ratio of the integrated image information amount on the transfer material in the downstream area with respect to the area of the downstream region or the width perpendicular to the conveying direction of the transfer material, and the electric field by the separating charger 7 is selected from the predetermined electric field amount and adjusted in accordance with the ratio. Therefore, for the image of any image ratio, the transfer material with the toner image transferred thereon can be separated from the photosensitive drum 1 without causing re-transfer or poor separability, and a good-quality image can be obtained.

(Second Embodiment)

A second embodiment of the present invention will next be described. The constitution similar to that of the first embodiment is denoted with the same reference numeral, and the description thereof is omitted.

In the embodiment, the separation difference current determined in the same manner as in the first embodiment is supplied only in the vicinity of the transfer material leading edge, and a low separation current than that of the leading edge portion is supplied to the middle to rear portion of the transfer material.

In the first embodiment, the separation difference current determined by the image ratio is supplied to the entire transfer material, but in the second embodiment, an appropriate separation difference current is supplied only to the vicinity of the leading edge portion of the transfer material. This can securely prevent an unnecessary large separation difference current from being supplied to the middle to rear portion of the transfer material, and prevent the toner transferred to the transfer material from being re-transferred to the photosensitive drum.

For example, in the original as shown in FIG. 5A, since the image ratio of the leading edge portion is low, a high separation difference current is supplied. However, when the high separation difference current is supplied to the solid black portion of the middle to rear portion of the transfer material, the re-transfer is easily caused. To separate the transfer material, when the transfer material leading edge portion is separated, the middle to rear portion of the transfer material can quickly be separated subsequent to the leading edge by the weight and rigidity of the transfer material.

Therefore, when an appropriate separation difference current is supplied only to the vicinity of the transfer material leading edge, and a lower separation difference current is supplied to the other middle to rear portion of the transfer material, no re-transfer occurs.

Figure 7:
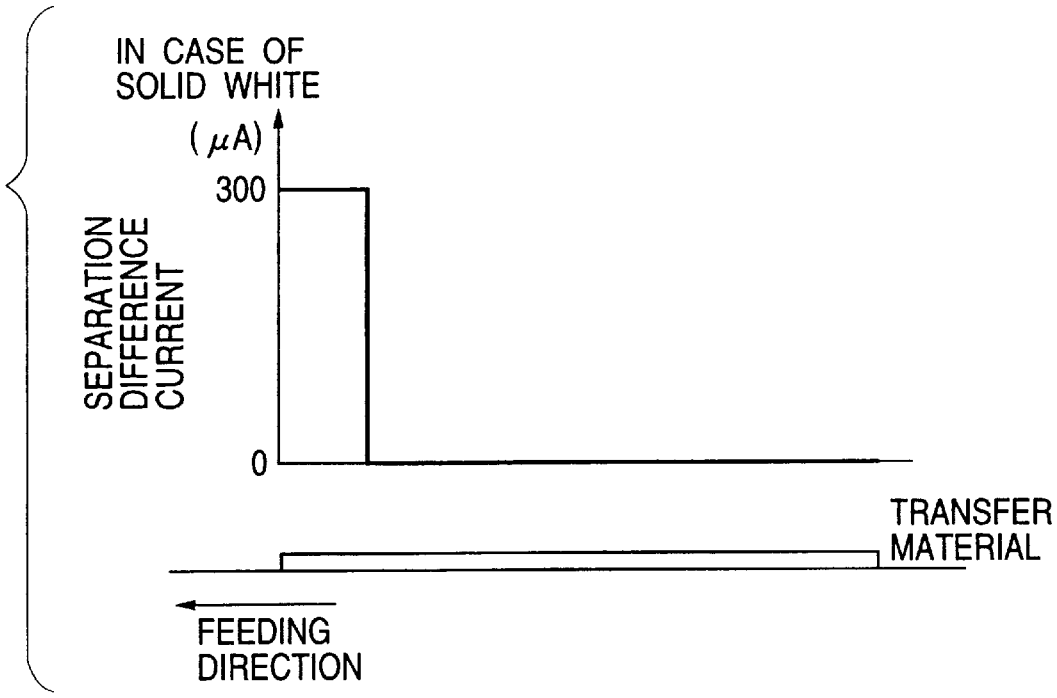
FIG. 7 is a diagram showing the separation difference current supplied when an original has a solid white image in a second embodiment of the present invention.

FIG. 7 is a graph showing the separation current supplied by the separating charger 7 when the original has a solid white image in the second embodiment.

The separation difference current (about 300 μA) determined based on the image ratio obtained by the video counter 20 is supplied up to 50 mm from the transfer material leading edge, and no separation difference current is supplied to the subsequent portion. It is preferable to allow the position for switching the separation difference current to substantially agree with the leading edge of 50 mm as the integrated length of the image ratio.

According to the embodiment, the transfer material leading edge portion is well separated with the adequate separation difference current, and the middle to rear portion of the transfer material can be separated without re-transferring the transferred toner to the photosensitive drum.

Thereby, according to the present embodiment, the transfer material can be separated without causing re-transfer or poor separability to the images of all the image ratios.

Therefore, according to the present embodiment, the video counter 20 integrates the image information amount corresponding to the downstream area in the range up to 50 mm from the conveying direction leading edge of the transfer material, the control circuit 40 calculates the ratio of the integrated image information amount on the transfer material in the downstream area with respect to the area of the downstream region or the width perpendicular to the conveying direction of the transfer material, and the separating charger 7 is adjusted so that the current obtained in accordance with the calculated ratio is supplied only to the downstream area of the transfer material and that a lower current is supplied to the area other than the downstream area of the transfer material. Therefore, with respect to the images of all the image ratios, the transfer material with the toner image transferred thereto can be separated from the photosensitive drum 1 without causing re-transfer or poor separability, and a good-quality image can be obtained.

(Third Embodiment)

A third embodiment of the present invention will next be described. Additionally, the constitution similar to that of the first embodiment is denoted with the same reference numerals, and the description thereof is omitted.

In the third embodiment, the image ratio for determining the separation difference current in the first embodiment is further developed.

In the embodiment, the image in the vicinity of transfer material leading edge is weighted, the image in the vicinity of the leading edge is made much of, and the separation difference current is determined.

The method of determining the separation difference current in the third embodiment will be described with reference to FIG. 8.

Figure 8:
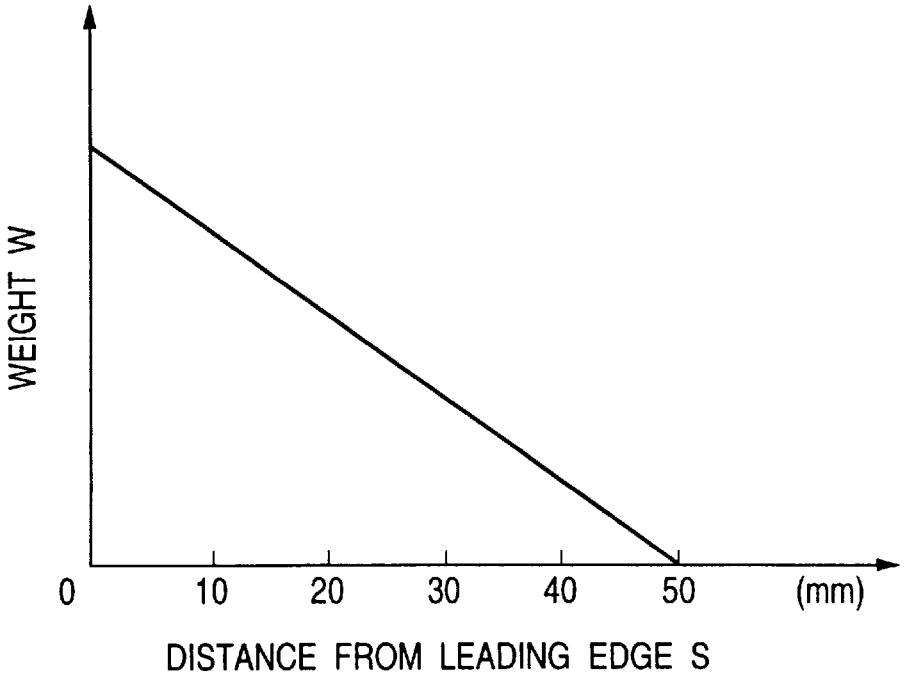
FIG. 8 is a diagram showing a relation between the weight applied to image information to determine the separation difference current and the distance from the conveying direction leading edge of the recording medium corresponding to the image information in a third embodiment of the present invention.

First, a weight Wi decreasing with a distance s (0 to 50 mm) from the transfer material leading edge as shown in FIG. 8 is applied to the image information amount Vi of the vicinity of the transfer material leading edge obtained by the video counter 20, a resulting value Vi×Wi is integrated, and a value obtained by dividing by the transfer material width L is used as a tentative image ratio.

Specifically, the tentative image ratio=(ΣVi×Wi)/L.

The separation current is determined from this value and the graph of FIG. 4 showing the relation between the image ratio and the separation difference current.

According to the embodiment, the optimum separation of the transfer material can further be realized for the image of the transfer material leading edge, and the separation efficiency can be enhanced.

Therefore, according to the present embodiment, the video counter 20 integrates the image information amount corresponding to the downstream area in the range up to 50 mm from the conveying direction leading edge of the transfer material by applying the weight to the portion closer to the conveying direction leading edge, the control circuit 40 calculates the ratio of the integrated image information amount on the transfer material in the downstream area with respect to the area of the downstream region or the width perpendicular to the conveying direction of the transfer material, and the electric field by the separating charger 7 is selected from the predetermined electric field amount and adjusted in accordance with the ratio. Therefore, for the image of any image ratio, the transfer material with the toner image transferred thereon can be separated from the photosensitive drum 1 without causing re-transfer or poor separability, and a good-quality image can be obtained.

The embodiments of the present invention have been described above, but the present invention is not limited to these embodiments, and various modifications can be realized within the technical scope.

What is claimed is:

1. An image forming apparatus comprising:

an image bearer for bearing a toner image;

transfer means for transferring the toner image on said image bearer to a recording medium;

separating charger for facilitating separation of the recording medium from said image bearer;

detecting means for detecting an image amount in a predetermined area on said image bearer, said predetermined area corresponding to a predetermined downstream side area from a leading edge of said recording material; and control means for controlling an application voltage to said separating charger from a leading edge to a trailing edge of the recording material on the basis of the image amount in said predetermined area detected by said detecting means.

2. An image forming apparatus comprising:

an image bearer for bearing a toner image;

transfer means for transferring the toner image on said image bearer to a recording medium;

separating charger for facilitating separation of the recording medium from said image bearer;

detecting means for detecting an image amount in a predetermined area on said image bearer, said predetermined area corresponding to a predetermined downstream side area from a leading edge of said recording material; and control means for controlling an application voltage to said separating charger from a leading edge to a trailing edge of the recording material on the basis of the image amount in said predetermined area detected by said detecting means, wherein said detecting means comprises a counter for integrating image data of the leading edge side area, and an operation circuit for calculating an image ratio from an integrated value of said counter.

3. The image forming apparatus according to claim 2 wherein said detecting means applies a weight to the image in the vicinity of a leading edge to count the value.

4. The image forming apparatus according to claim 1, wherein said predetermined area has a length of 20 to 100 mm from the leading edge.

5. An image forming apparatus comprising:

an image bearer for bearing a toner image;

transfer means for transferring the toner image on said image bearer to a recording medium;

separating charger for facilitating separation of the recording medium from said image bearer;

detecting means for detecting an image amount in a predetermined area on said image bearer, said predetermined area corresponding to a predetermined downstream side area from a leading edge of said recording material; and control means for controlling an application voltage to said separating charger from a leading edge to a trailing edge of the recording material on the basis of the image amount in said predetermined area detected by said detecting means, wherein said control means switches the application voltage in the transfer material leading edge portion and the subsequent rear area.

6. The image forming apparatus according to claim 5 wherein said control means applies the voltage to the transfer material leading edge portion based on the output of said detecting means, and applies the voltage which is not related with the output of said detecting means to the rear area.

* * * * *

UNITED STATES PATENT AND TRADEMARK OFFICE

CERTIFICATE OF CORRECTION

PATENT NO. : 6,173,150 B1
DATED : January 9, 2001
INVENTOR(S) : Shinya Suzuki et al.

It is certified that error appears in the above-identified patent and that said Letters Patent is hereby corrected as shown below:

Title page,
Item [57] ABSTRACT, "transfer" should read -- a transfer --.

Column 1,
Line 60, "less" should read -- little --.

Column 2,
Line 4, "Further" should read -- A further --.

Column 3,
Line 23, "drive" should read -- driver --.

Column 7,
Line 60, "low" should read -- lower --.

Signed and Sealed this

Tenth Day of May, 2005

JON W. DUDAS
*Director of the United States Patent and Trademark Office*